United States Patent [19]

Irmscher

[11] 4,260,023

[45] Apr. 7, 1981

[54] AUTOMATIC FIRE EXTINGUISHER FOR CHIMNEYS HAVING A FLOAT OPERATED FLAG

[76] Inventor: Edward Irmscher, Star Rte., Hortonville, N.Y. 12745

[21] Appl. No.: 84,098

[22] Filed: Oct. 12, 1979

[51] Int. Cl.[3] ..... A62C 37/12

[52] U.S. Cl. ..... 169/57; 116/217; 116/228; 169/54; 169/42

[58] Field of Search ..... 169/42, 54, 56, 57, 169/59, 60, DIG. 1, 26; 222/51; 239/71, 73; 116/217, 228; 73/321

[56] References Cited

U.S. PATENT DOCUMENTS

| | | | |
|---|---|---|---|
| 883,149 | 3/1908 | Shafer | 169/57 |
| 1,790,995 | 2/1931 | McErlane | 169/26 |
| 2,011, 803 | 8/1935 | Dube | 169/54 X |
| 2,939,419 | 6/1960 | Hawkins | 116/228 |
| 3,090,232 | 5/1963 | Mayes | 73/321 |
| 3,526,201 | 9/1970 | Larson | 116/228 X |
| 3,852,380 | 12/1974 | Wiseman | 116/228 X |

FOREIGN PATENT DOCUMENTS

| | | | |
|---|---|---|---|
| 22311 | 4/1936 | Australia | 116/228 |

*Primary Examiner*—Robert J. Spar
*Assistant Examiner*—Fred A. Silverberg

[57] ABSTRACT

This device provides a method of automatically extinguishing a fire that may occur in a chimney and it contains an indicating flag that rises when the extinguishing fluid has been discharged onto a fire in the chimney, upon which it is installed. The device includes an elongated and refillable container that is mounted in the top of the chimney, and it further includes a deflector at the bottom, which will create a spray effect when the fluid strikes it.

5 Claims, 3 Drawing Figures

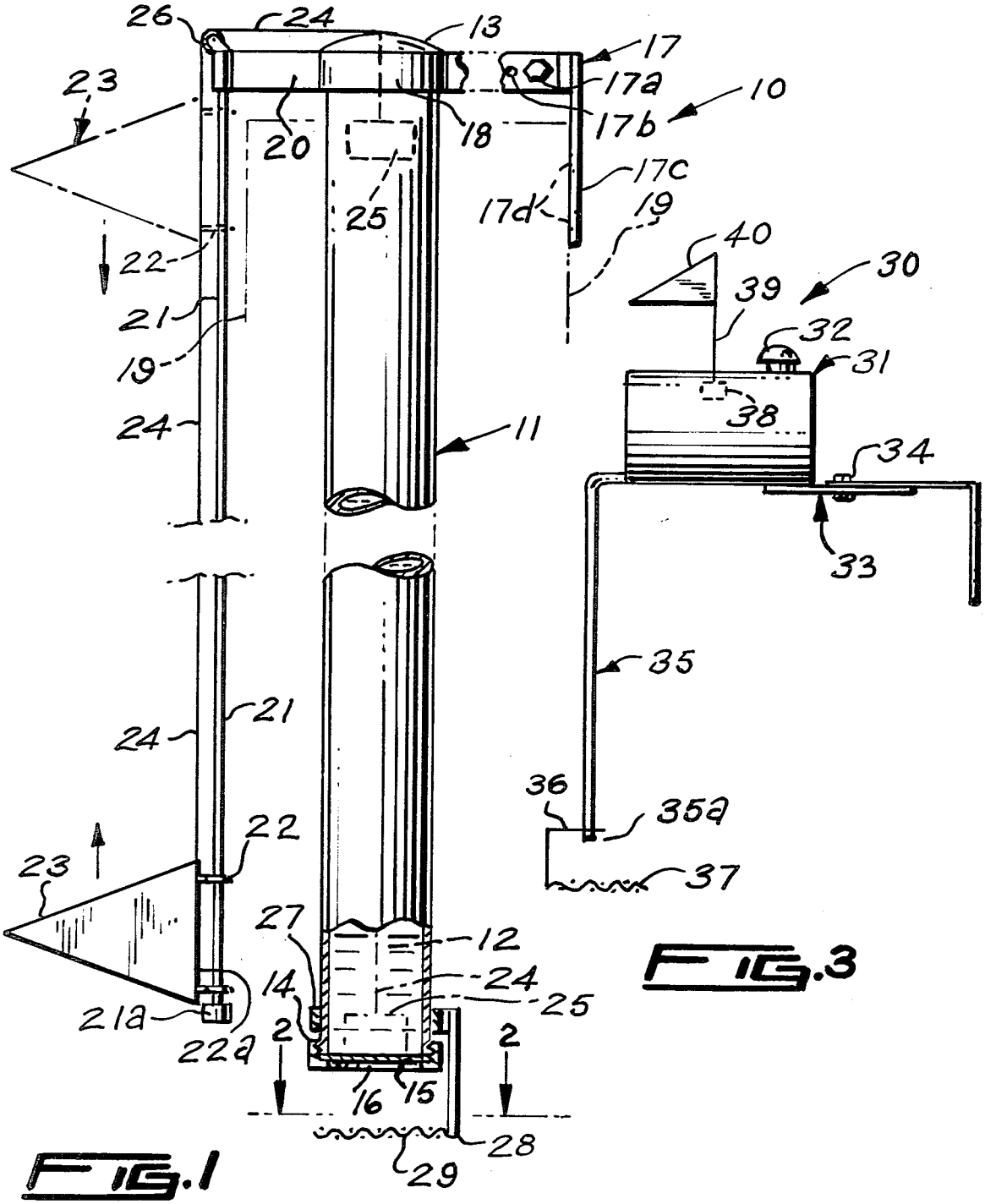
FIG. 1
FIG. 3
FIG. 2
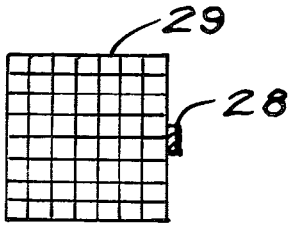

AUTOMATIC FIRE EXTINGUISHER FOR CHIMNEYS HAVING A FLOAT OPERATED FLAG

This invention relates to fire extinguishers, and more particularly to an automatic fire extinguisher for chimneys.

It is therefore the primary object of this invention to provide an automatic fire extinguisher for chimneys, which will be mounted in a chimney, and will contain a suitable fire extinguishing liquid, that will be discharged onto a fire that may occur in the chimney.

Another object of this invention is to provide an automatic fire extinguisher for chimneys, which will be of such structure, so as to be refillable after its contents are discharged upon a fire.

Another object of this invention is to provide an automatic fire extinguisher for chimneys, which will have flag means for indicating that a fire occurred in the chimney, so as to enable the user to know that the container of the device needs refilling.

A further object of this invention is to provide an automatic fire extinguisher for chimneys, which will employ the use of a replaceable disc of a low melting point, such as a solder type alloy, that will melt when a fire occurs in the chimney, thus causing the fire extinguishing liquid to be discharged onto a fire in the chimney.

A still further object of this invention is to provide an automatic fire extinguisher, which will employ the use of a deflector device in the discharge area of the liquid filled container of the structure, so as to spread the liquid being discharged onto the fire.

Other objects of the invention are to provide an automatic fire extinguisher for chimneys, which will be simple in design, inexpensive to manufacture, rugged in construction, efficient in operation, and easy to install.

These and other objects will become readily evident, upon a study of the specification and the accompanying drawing, in which:

FIG. 1 is a vertical view of the present invention, shown in elevation and partly in section, and illustrates the raised position of the indicator flag in phantom;

FIG. 2 is a cross-sectional view taken along the line 2—2 of FIG. 1, and

FIG. 3 is a side view of a modified form of the invention, shown in elevation and on a smaller scale.

According to this invention, fire extinguisher 10 is shown to include an elongated cylindrical container 11, which is filled with a suitable fire extinguishing solution 12, such as, sodium bicarbonate, which is placed into container 11, by removing cap 13 from the upper end. Solution 12 is retained in container 11, by means of screw-cap 14 on the opposite end, and a replaceable disc 15 of a solder type alloy, is retained against the lower end of cylinder 11, by the rim portion of the opening 16 in screw-cap 14.

It shall be recognized, that disc 15, being of a soft metal alloy, also provides gasket sealing means between the lower end of cylinder 11, and the screw-cap 14, thus preventing any leakage of solution 12, until a fire occurs and melts disc 15, and causes the discharge of solution 12 onto a fire.

An adjustable mounting bracket 17 is fixedly secured to a collar 18 in a suitable manner, (not shown), and includes a bolt fastener **17*a*, which may be received in any of the openings 17*b* for extending the attached arm 17*c* for receiving suitable fasteners in the openings 17*d*, for rendering fire extinguisher 10 stationary to chimney 19**.

It shall also be noted, that cylinder 11 extends downwards into the upper end of chimney 19, and an arm 20 fixedly secured to collar 18, has an elongated rod 21 fixedly secured thereto at one end and rod 21 extends down the outside of chimney 19, for a purpose which hereinafter will be described.

A pair of spaced apart eyes 22 are fixedly secured to the back edge **22*a* of a red or otherwise colored flag 23, and the eyes 22 are freely received on the rod 21, so as to enable flag 23 to rise by means of its attached cable 24 which is very flexible. Cable 24 is secured fixedly at its opposite end to the top of a float 25, which floats on the top of solution 12 in container 11, when it is at its full level, and cable 24 is freely and slidably received in an opening (not shown) in cap 13, and is carried on pulley 26 secured to the top of arm 20. When a fire occurs in chimney 19, and solution 12 is discharged from opening 16 of screw-cap 14 when disc 15 melts, the float 25 will descend downwards to the bottom of container 11, and the flag 23 will simultaneously rise on rod 21 by the attached cable 24, thus indicating to the user, that a fire has occurred and the container requires refilling with solution 12**.

A collar 27 is fixedly secured to the bottom area of container 11 in a sutiable manner and an arm 28 is fixedly secured thereto, and extend downwards from screw-cap 14. The extending end of arm 28 has fixedly secured thereto, and extends downwards from screw-cap 14. The extending end of arm 28 has fixedly secured thereto, a deflector screen 29 at one side edge, so as to break up and spread the solution 12 onto a fire for the most effective results in extinguishing the fire.

It shall be even further noted, that a knob **21*a* formed on the free end of rod 21, provides stop means for an eye 22 of flag 23, so as to prevent flag 23 from leaving rod 21 when filler cap 13 is removed for refilling container 11**.

A modified form of extinguisher 30 as shown in FIG. 3 of the drawing, is shown to consist of a cylindrical container 31 having a removable and vented filler cap 32. Container 31 has fixedly secured to its underside, an adjustable mounting bracket 33, adjustable by means of bolt fastener 34, for any size chimney. Bracket 33 is mounted in a manner similar to that heretofore described of extinguisher 10, and pipe 35 of container 31, extends downwards into a chimney and is provided with a screw-cap **35*a*, which has a similar disc (not shown) as that described of extinguisher 10, for melting and releasing the solution from container 31, onto a chimney fire. Pipe 35 includes an "L" shaped bracket 36, secured fixedly above screw-cap 35*a*, which has suitably attached thereto, a deflector screen 37, that is spaced below the screw-cap 35*a* for spreading the solution discharged as heretofore described of deflector 29 of extinguisher 10**.

A float 38 in container 31, is secured fixedly to a wire 39 that extends out of container 31, and an indicator flag 40 is secured fixedly to the extending end of float 38. The wire 39 is freely and slidably received in an opening (not shown) in container 31, and when the solution is discharged, the float 38 descends and the flag will lower, so as to indicate to the user, that a fire has occurred in the chimney and container 31 requires refilling.

While various changes may be made in the detail construction, such changes will be within the spirit and scope of the present invention, as is defined by the appended claims.

What I claim is:

1. An automatic fire extinguisher for chimneys, comprising, in combination, a container, depending within a chimney, a fire extinguishing solution received in said container, an adjustable bracket secured to said container for mounting it to a chimney, a float received in said container with an attached cable for elevating a flag to indicate when a fire has occurred in the chimney, and when the fire extinguishing solution has been discharged, and a screw-cap with a fire meltable disc, is secured to said container for retaining the fire extinguishing solution in said container.

2. The combination according to claim 1, wherein said container removably receives a filler cap at one end for filling said container with the fire extinguishing solution, a collar secured fixedly to the outer periphery of said container, beneath said filler cap and said adjustable bracket is fixedly secured to said collar at one end and is secured at its outer end to a chimney by bolt fasteners, and the opposite side of said collar includes an arm fixedly secured thereto, at one end and the opposite end is fixedly secured to one end of a rod that is parallel spaced from said container on the outside of the chimney, said rod freely and slidably receiving a pair of spaced apart eyes fixedly secured to said flag.

3. The combination according to claim 2, wherein said flag is secured to said cable fixedly at one end, and the opposite end of said cable is fixedly secured to the top of said float, and said cable is freely received on a pulley rotatably secured to the top of said arm, and said cable is freely and slidably received through an opening included in said filler cap, and when said float is in the top of said container within the fire extinguishing solution, said flag is on the bottom portion of said rod, and when said float descends to the bottom of said container after the discharge of the fire extinguishing solution by heat from a chimney fire, said flag elevates to the top of said rod.

4. The combination according to claim 3, wherein said screw-cap is removably threaded onto the opposite end of said container and removably receives said fire meltable disc on its interior, and one face of said fire meltable disc abuts with the discharge opening in said container and the opposite face abuts with the shoulder portion of the rim defined by a discharge opening included in said screw-cap, and said fire meltable disc provides end wall retaining means and gasket means against leakage of the fire extinguishing solution from said container, until a fire occurs in the chimney.

5. The combination according to claim 4, wherein a deflector comprises a collar that is fixedly secured in a suitable manner to the outer periphery of said container and is spaced from said screw-cap, said collar of said deflector, including an arm fixedly secured to one side edge of a screen which when a discharge of the fire extinguishing solution occurs, will break up and spread the solution onto the fire in the chimney.

* * * * *